United States Patent [19]

Lambert

[11] 3,976,216

[45] Aug. 24, 1976

[54] STERILE BOTTLE CLOSURE

[75] Inventor: Jack R. Lambert, Lexington, Mass.

[73] Assignee: Thermo Electron Corporation, Waltham, Mass.

[22] Filed: Dec. 26, 1974

[21] Appl. No.: 536,560

[52] U.S. Cl. ..... 215/307; 215/260; 215/270; 215/271

[51] Int. Cl.[2] ..... B65D 51/16

[58] Field of Search ..... 215/260, 261, 270, 271, 215/307

[56] References Cited

UNITED STATES PATENTS

| | | | |
|---|---|---|---|
| 205,469 | 7/1878 | Blackburn | 215/307 |
| 1,142,291 | 6/1915 | Weber | 215/354 |
| 1,814,141 | 7/1931 | Fox | 215/260 |
| 1,869,938 | 8/1932 | Ingram | 215/260 |
| 2,242,966 | 5/1941 | Burkardt | 215/307 |
| 2,634,014 | 4/1953 | Kimber | 215/271 |
| 3,102,651 | 9/1961 | Boese | 215/307 |
| 3,589,545 | 6/1971 | Carpenter | 215/260 |

FOREIGN PATENTS OR APPLICATIONS

| | | | |
|---|---|---|---|
| 582,158 | 5/1924 | France | 215/307 |
| 1,468,938 | 11/1965 | France | 215/307 |
| 484,450 | 9/1953 | Italy | 215/307 |

*Primary Examiner*—Ro E. Hart
*Attorney, Agent, or Firm*—James L. Neal

[57] ABSTRACT

A ventible closure for a container adapted to hold sterile fluids wherein the container has a neck with an open end surrounded by a beaded rim. The closure includes a rigid plug which fits down into the container neck and an elastic cap fitting over the open end of the neck in engagement with the rigid plug and the beaded rim to seal the container. For venting, internal pressure within the container causes outward flexing of the elastic cap to break the seal and establish flow paths for the fluid to escape from the container.

6 Claims, 6 Drawing Figures

STERILE BOTTLE CLOSURE

SUMMARY OF THE INVENTION

This invention relates to closures and more particularly ventible closures adapted for use on necked containers having an open end surrounded by a peripheral bead.

In the medical field there is a substantial need for a ventible closure which can be applied to containers wherein the fluid contents thereof are to be heated for sterilization and thus produce increased fluid pressure within the containers which must necessarily be vented. Thus, even though venting is required, a sterile condition must be maintained at all times within the containers. Obviously, care must be taken to make certain that when the venting is completed and the pressure within the container is less than ambient pressure, nothing will be drawn into the container through the vent passages. The ventible closure disclosed herein will provide the venting and sealing required to maintain sterility.

In view of the foregoing, it is an object of this invention to provide a ventible closure which will meet all operating and sterility requirements in connection with containers wherein internal pressure may require venting and reseal and yet provide continuous sterile conditions.

It is another object of this invention to provide a ventible closure comprising a rigid plug fitting down into the neck of the container and an elastic cap fitting over the neck of the container to sealingly engage the plug and container neck.

It is another object of the invention to provide a ventible closure as above and wherein fluid pressure from within the container outwardly flexes the elastic cap to establish a flow path for the escape of the pressurized fluid.

It is yet another object of this invention to provide a ventible closure which is inexpensive to manufacture mainly because of the wide tolerances allowable in the cooperating elements of the closure.

It is a still further object of this invention to provide a ventible closure which will maintain sterility of the rim and a portion of the upper neck of the container as is required to prevent exiting fluid from contacting any non-sterile surface of the container when dispensing the fluid from the container.

The above and other objects and advantages will become more apparent when considered in conjunction with the following detailed description and drawing.

IN THE DRAWINGS

Figure 4:
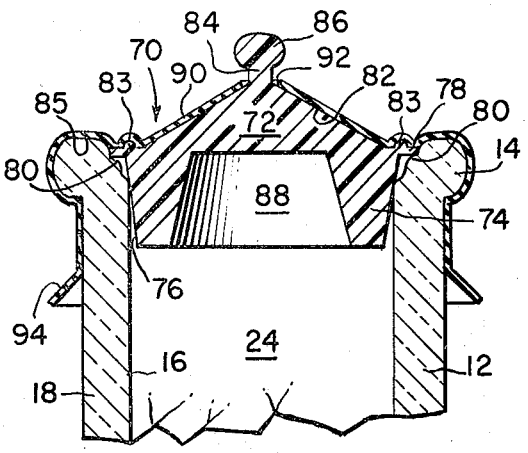

FIG. 4 is a sectional view of a second embodiment of this invention wherein the rigid plug fits within the container neck and is raised by fluid pressure within the container to allow pressurized fluid to escape between the inner wall of the container neck and the rigid plug and then to pass between confronting portions of the plug and elastic cap to exhaust through the central vent opening in said cap.

Figure 2:
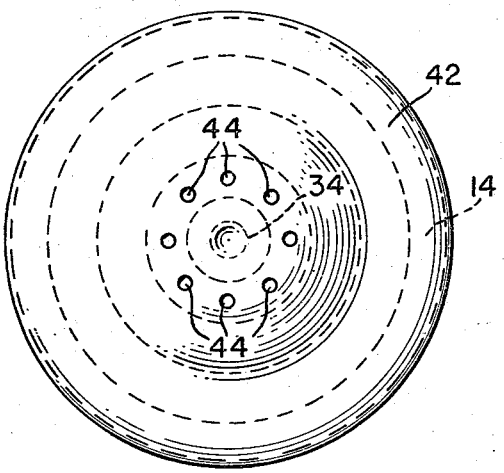
FIG. 2 is a top plan view of the embodiment of FIG. 1, illustrating the arrangement of vent openings in the elastic cap.
Figure 5:
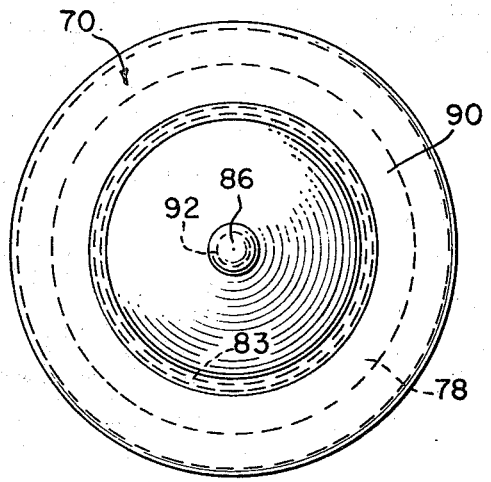
Figure 6:
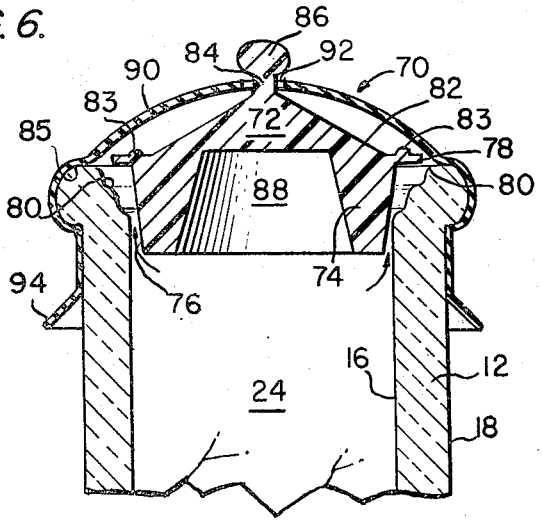

FIG. 5 is a top plan view of the embodiment of FIG. 2 showing the positioning of the elastic cap in the container neck, and FIG. 6 is a sectional view of the embodiment of FIG. 4 and illustrates the position of the closure elements for venting.

DETAILED DESCRIPTION

Figure 1:
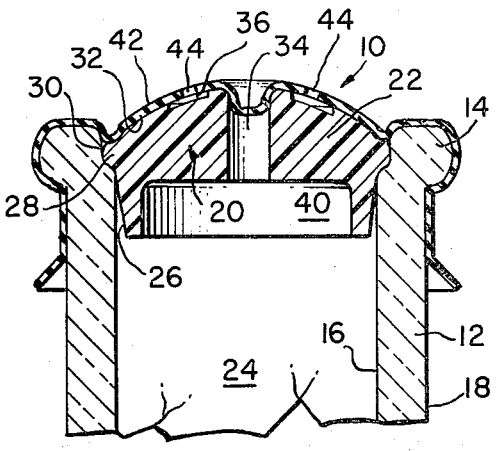
FIG. 1 is a sectional view illustrating an embodiment of this invention wherein the plug fitting within the container neck is provided with a vent hole for exhausting pressurized fluid in the container through vent openings in the flexible cap when said cap is flexed upwardly away from the plug.
Figure 3:
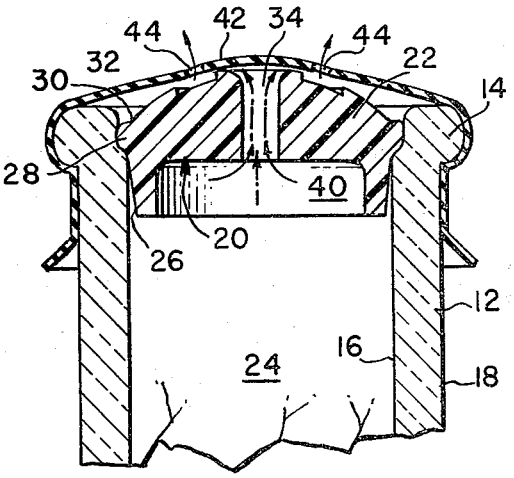
FIG. 3 is a sectional view of the embodiment of FIG. 1 showing the position of the closure elements for venting.

The ventible closure 10 illustrated in FIGS. 1–3 as well as the closure 70 shown in FIGS. 4–6 are both adapted for use in conjunction with a container having a neck 12 with an open end surrounded by a beaded rim 14. The neck 12 has generally parallel inner and outer walls 16 and 18 respectively.

The ventible closure 10 illustrated in FIGS. 1–3 includes a rigid plug 20 fitting down into the neck 12 of the container. More particularly, the rigid plug 20 comprises a generally circular body 22 sized to freely fit within the neck bore 24 defined by the inner wall 16. It should be noted that for ease of operation and fit the outer surface 26 of the body 22 tapers slightly inwardly from top to bottom. The top edge portion of the body is provided with a peripheral flange 28 fitting in an annular recess 30 in the top inner portion of the neck 12.

The top surface 32 of the plug 20 is slightly convex with the highest section being medially located. The plug 20 is formed with a central vent hole 34 extending completely therethrough. An annular vent groove 36 is located in the top surface 32 in equidistant relation to the central vent hole 34. The lower portion of the plug body 22 may be recessed to form a chamber 40 if desired.

The entire open end of the neck 12 is covered by an elastic cap 42 which fits over the top surface 32 of the plug 20 as well as the beaded rim 14 and on down over a portion of the neck outer wall 18. The elastic cap 42, which may be latex, is provided with a plurality of vent openings 44 registering with annular vent groove 36 in the plug. It should be noted that the elastic cap 42 snugly bears against the beaded rim 14, the entire top surface 32 of the plug 20 and down into the central vent hole 34. In addition, the cap is literally drawn down into the top portion of the circular joint formed between the top surfaces 32 and the recess 30 in the top portion by the pressure differential, between the interior of the container and that outside of the container, produced after sterilization in an autoclave.

In use, after the container has been suitably filled, the plug 20 is inserted in the container neck with the flange 28 resting freely in the recess 30. After this the elastic cap 42 is stretched over and applied to the container neck 12 to establish a preliminary seal by closing off the central vent hole 34 and the top portion of the circular joint formed between the rigid plug 20 and the upper portion of the body wall 16 which in FIG. 1 is recess 30. The contact between the elastic cap 42 and the elements therebeneath such as the top surface 34 of the plug 20 and the beaded rim 14 as well as the upper portion of the outer wall 18 of the container neck 12 is sufficient to provide a sterile seal without a pressure differential existing between the inside and outside of the container.

In sterilizing the container contents the container in preliminarily sealed condition is placed in an autoclave and the requisite heat is applied to sterilize the container contents. This heating produces an internal fluid pressure greater than that outside the container, thus venting becomes desirable. Pressure from within causes the elastic cap 42 to flex and stretch upwardly and outwardly to break the seal and establish an exhaust flow path which, as illustrated by the arrows in FIG. 3 comprises central vent hole 34, annular vent groove 36 and cap vent openings 44. The annular groove 36 can be eliminated and thus the flow path would comprise only the central vent hole 34 and the vent openings 44. Upon completion of sterilization process reduced temperature within the container will develop a pressure within the container which is less than ambient pressure thus final sealing will take place as illustrated in FIG. 1 wherein the cap 42 is drawn down into center vent hole 34 to seal off said hole. Further, that portion of the cap adjacent the top portion of the circular joint formed between the plug flange 28 and neck recess 30 will be drawn down tightly thereover to assure sealing of such joint. Thus the container is ready for use or storage as needs dictate.

Referring to the embodiment illustrated in FIGS. 4–6, the ventible closure 70 comprises a rigid plug 72 fitting down into the neck 12 of the container. More specifically, the rigid plug 72 comprises a generally round body 74 sized to freely fit within the neck bore 24 defined by the inner wall 16. It will be noted that the outer surface 76 of body 72 tapers downwardly and inwardly to facilitate insertion of the plug 72 into the neck opening. The top portion of the plug body 72 is provided with a peripheral outwardly extending flange 78 which fits on the inner shoulder 80 of the rim 14 whereby the top of the flange and the annular bead 83 thereon are flush or below the top 35 of the rim 14. The top surface 82 of the plug 72 slopes upward from its edge centerward terminating in an apex 84 which mounts a circular knob 86. The bottom portion of the plug body may be recessed as indicated at 88 if desired. The annular bead 83 on the top surface of the flange 28 is useful in providing an additional sealing area.

The entire open end of the container neck 12 is sealingly covered by an elastic cap 90 which fits over the top surface 82 of the plug 72 as well as the beaded rim 14 and down over a portion of the neck outer wall 18. The seal between the cap 90 and annular bead 83 is a secondary one but even so it is useful to assure complete sealing of the contents of the container. The cap 90 is provided with a central aperture 92 which allows the cap to be passed down over knob 86. In this embodiment as in that illustrated in FIGS. 1–3, the elastic cap 90 snugly bears against the rigid plug 72, the beaded rim 14 and thus acts to seal off the joint formed by the engagement of the plug flange 78 with shoulder 80 of the rim 14. Without a pressure differential the elastic cap 90 provides a preliminary sterile seal for the container due to its elastic nature.

In use, plug 72 is positioned in the neck 12 of the container with the plug flange 78 resting on the shoulder 80 of the rim 14. Next, the elastic cap 90 is fitted over the plug 72 by passing the plug knob 86 through cap aperture 92 and then pulling the cap down smoothly so that it sealingly engages the top surface 82 of the plug 72, the beaded rim 14 and the neck outer wall 18. As previously stated, even though there is no pressure differential at this state the elasticity and degree of stretch involved in assembling the cap on the container neck assures an effective seal.

Referring to FIG. 6, as in the first embodiment in sterilizing the container contents, an internal pressure is developed which is greater than the outside pressure. This internal pressure forces the plug 72 upwardly to unseat the plug and create a gap between the neck inner wall 16 and the plug body surface 76 as well as a space between the plug flange 78 and the shoulder 80 of the rim 14. Further pressure causes additional stretching of the elastic cap 90 whereby a space is established between the cap 90 and the top surface 82 of the plug 72 so that the pressure may be exhausted through vent aperture 92 in the cap. Upon completion of the sterilization process, cooling will effect a diminution of fluid pressure within the container whereupon the plug 72 will drop down into the neck 12 with its flange 78 engaging shoulder 80 of rim 14 and with the elastic cap 90 sealingly engaging the plug 72, annular bead 83, the rim 14 and the neck outer wall 18 to provide a final seal.

It should be noted in connection with the embodiment of FIGS. 4–6 that the elastic cap 90 is loosely connected to the plug 72 by means of knob 86. The cap vent hole 92 is sized to snugly engage the plug apex 84 thus the cap will not readily become disengaged from the plug. Further, it is possible to remove the closure 70 from the container neck by merely pulling upwardly on the skirt 94 of the cap 90 and freeing the cap from the rim 14. Since the plug 72 fits rather freely in the container neck, very little force is required to remove it, thus there is no possibility of disengaging the cap and plug when removing the closure by gripping and pulling on the cap alone.

What is claimed is:

1. A closure for a container adapted to hold sterile fluids said container including a neck formed with inner and outer walls, said neck having a rim at its upper and open end, said closure comprising:

a rigid plug adapted to fit down into the upper portion of the neck of the container, said plug having a body sized to fit within the inner wall of the container neck, venting means for communicating with the inside of the container and the ambient air and a central portion for extending above the plane of the container rim outward from said container neck, and an elastic, fluid impervious cap adapted to fit over the open end of the container neck and down on the rim with its peripheral extremity engaging the outer wall of the container neck below the rim, said cap applying to the central portion of the plug an inwardly directed force and sealingly covering the venting means, the cap being provided with ventilating means out of registry with the venting means and adapted to be fluidly connected to the venting means, whereby when the pressure within the container exceeds the ambient pressure, the elastic cap will flex upwardly and allow pressurized fluid in the container to pass through the venting means and out the ventilating means in the cap and whereby, upon reduction of pressure within the container, the cap engages the rigid plug and container neck to seal as aforedescribed.

2. The invention as set forth in claim 1 and wherein the body comprises a central vent hole and an annular vent groove in the upper surface of the body surrounding and spaced from the central hole and wherein the ventilating means in the elastic cap registers with the aforesaid vent groove.

3. The invention as set forth in claim 1 wherein:

said plug comprises a flange extending from the outer surface of the body, said flange being adapted to engage a shouldered portion of the rim forming the upper open end of the container neck, and a centrally positioned shank extending upwardly from the top central portion of the body, said body top sloping upwardly from the flange to form an apex from which the shank extends, and said cap comprises a central aperture forming said ventilating means and fitting down over the shank.

4. The invention as set forth in claim 3 and wherein the flange is provided with an annular bead on its upper surface to assist in sealing the container.

5. The invention as set forth in claim 3 and wherein a knob is connected atop said shank and further wherein the size of the central aperture in the elastic cap in its unstretched condition is greater than that of the shank so that it will surround said shank in a spaced manner.

6. The invention as set forth in claim 5 and wherein the central aperture in the elastic cap is smaller than the knob so that the cap must be stretched to enlarge the central aperture for passage of the knob therethrough whereby the cap and the plug will remain assembled even after removal from the container.

* * * * *